US008371149B2

(12) United States Patent
Vogel

(10) Patent No.: US 8,371,149 B2
(45) Date of Patent: Feb. 12, 2013

(54) METHODS FOR FORMING SHEET METAL COMPONENTS HAVING THREE-SIDED CORNERS AND RELATED COMPONENTS AND SYSTEMS

(75) Inventor: Andreas Vogel, Ispringen (DE)

(73) Assignee: Trumpf Laser- und Systemtechnik GmbH, Ditzingen (DE)

( * ) Notice: Subject to any disclaimer, the term of this patent is extended or adjusted under 35 U.S.C. 154(b) by 0 days.

(21) Appl. No.: 13/181,901

(22) Filed: Jul. 13, 2011

(65) Prior Publication Data

US 2011/0305918 A1 Dec. 15, 2011

Related U.S. Application Data

(63) Continuation of application No. PCT/DE2009/001721, filed on Dec. 3, 2009.

(30) Foreign Application Priority Data

Jan. 13, 2009 (DE) ..... 10 2009 004 798

(51) Int. Cl.
*B21D 31/00* (2006.01)
*B21D 43/28* (2006.01)
*B21K 27/06* (2006.01)

(52) U.S. Cl. ..... 72/379.2; 72/324

(58) Field of Classification Search ..... 72/324, 72/379.2

See application file for complete search history.

(56) References Cited

U.S. PATENT DOCUMENTS 568,680 A * 9/1896 Henderson ..... 220/89.2
1,431,173 A * 10/1922 O'Connor ..... 72/335
2,086,225 A * 7/1937 Hiering ..... 72/379.2
2,097,927 A * 11/1937 Klemp ..... 72/379.2
3,148,481 A * 9/1964 Swann ..... 52/53
3,771,342 A * 11/1973 Alleaume et al. ..... 72/379.2
5,203,069 A * 4/1993 Hennig ..... 29/557
5,359,872 A * 11/1994 Nashiki ..... 72/16.1
5,628,114 A * 5/1997 Stern ..... 29/897.312
6,065,668 A * 5/2000 Natali ..... 228/204
6,144,896 A 11/2000 Kask et al.
6,412,325 B1 * 7/2002 Croswell ..... 72/324
6,460,007 B1 * 10/2002 Morrissett ..... 702/150
6,463,651 B1 * 10/2002 Koeneker et al. ..... 29/513
6,640,605 B2 * 11/2003 Gitlin et al. ..... 72/379.2

(Continued)

FOREIGN PATENT DOCUMENTS

DE 4128194 A1 3/1993
DE 19531103 A1 * 2/1997

OTHER PUBLICATIONS

Machinery's Handbook 26th edition, Industrustrial Press Inc. copyright (c) 2000, ISBN 0-8311-2666-3.*

(Continued)

*Primary Examiner* — Edward Tolan
*Assistant Examiner* — Lawrence J Averick
(74) *Attorney, Agent, or Firm* — Fish & Richardson P.C.

(57) ABSTRACT

A sheet metal component that is bent from a sheet metal blank includes at least one three-sided corner. Two edges of the three-sided corner are formed by a first bending member of the sheet metal blank bent about a first inner bending radius $R_{i,1}$ and a second bending member of the sheet metal blank bent about a second inner bending radius $R_{i,2}$, and the third edge of the three-sided corner is formed by a first blank edge of the first bending member and a second blank edge of the second bending member. The sheet metal blank has an internal corner that forms the first blank edge, the second blank edge, and a wedge-like recess that opens in the internal corner.

9 Claims, 3 Drawing Sheets

U.S. PATENT DOCUMENTS

| | | | | |
|---|---|---|---|---|
| 7,440,874 | B2 * | 10/2008 | Durney et al. | 703/1 |
| 7,637,137 | B2 * | 12/2009 | Akamizu et al. | 72/379.2 |
| 7,643,967 | B2 * | 1/2010 | Durney et al. | 703/1 |
| 7,693,696 | B2 * | 4/2010 | Forrest et al. | 703/7 |
| 2004/0173587 | A1 * | 9/2004 | Musselman | 219/121.64 |
| 2006/0011592 | A1 * | 1/2006 | Wang et al. | 219/121.64 |
| 2007/0163121 | A1 * | 7/2007 | Keys et al. | 29/897.2 |

OTHER PUBLICATIONS

International Preliminary Report on Patentability for corresponding PCT Application No. PCT/DE2009/001721, issued Aug. 2, 2011, 9 pages.

International Search Report from corresponding PCT Application No. PCT/DE2009/001721, mailed May 12, 2010, 4 pages.

* cited by examiner

METHODS FOR FORMING SHEET METAL COMPONENTS HAVING THREE-SIDED CORNERS AND RELATED COMPONENTS AND SYSTEMS

CROSS-REFERENCE TO RELATED APPLICATIONS

This application is a continuation of, and claims priority under 35 U.S.C. §120 to, PCT Application No. PCT/DE2009/001721, filed on Dec. 3, 2009, which claimed priority to German Patent Application No. DE 10 2009 004 798.0, filed on Jan. 13, 2009. The contents of both of these priority applications are hereby incorporated by reference in their entirety.

TECHNICAL FIELD

This invention relates to methods for forming sheet metal components having three-sided corners and to related components and systems.

BACKGROUND

For laser welding boxes, hoods, or other sheet metal components, the components are intended to be constructed in such a manner that the necessary gap tolerances for subsequent manufacturing processes are achieved. The three-sided corners of the sheet metal component may generally have a maximum gap of 0.1 to 0 2 mm for adequate subsequent welding results and process reliability. The sheet metal members are further intended to be constructed to overlap by a specific dimension. Typically, in the region of visible seams, overlapping of at least approximately 70% of the sheet metal thickness is recommended. Accordingly, the preparation of the component requires a corner construction which should be taken into consideration between two bent members of the initial sheet metal blank. As known, wedge-like recesses can be provided in the internal corner of the sheet metal blank between two bending members to prevent compression and associated expansion of the bent members in that region during the bending operation.

SUMMARY

In some aspects of the invention, a sheet metal component is bent from a sheet metal blank and has at least one three-sided corner, where two edges of the three-sided corner are formed by a first and a second sheet metal member of the sheet metal blank bent about an inner bending radius, and the third edge of the three-sided corner is formed by two blank edges of the two bent sheet metal members. The sheet metal blank has an internal corner which forms the two blank edges and a wedge-like recess which opens in the internal corner and is formed by two wedge members and a rounded wedge tip.

In some aspects of the invention, the gap width provided between the two bent sheet metal members in a sheet metal corner component is reduced to a small gap dimension that is typically used for laser-welding the two sheet metal members or in visible edges having tight tolerance requirements.

In some aspects of the invention, methods are provided for producing a three-sided corner bent from a sheet metal blank.

Generally, during free bending without subsequent processing steps, a ¾ circular recess is produced by a stamping operation with the diameter d along interior bending lines. Resulting diameters d that are generally produced based on sheet metal thicknesses t are provided in the table below.

| Sheet metal thickness t [mm] | Ø d ± 0.5 [mm] |
|---|---|
| t < 2 | 3 |
| 2 < t ≦ 4 | 5 |
| 4 < t ≦ 6 | 7 |

When special requirements are placed on the design of a corner which is not welded or rough-cast, the shape of the corner recess can be optimized by construction dimensions being established and produced by laser welding processes. The dimensions of the wedge-like recesses discussed above are established empirically and can be stored in tables in computer systems. Alternatively, CAD systems offer the possibility of generating wedge-like recesses using computer design systems, the construction dimensions of the wedge-like recesses using computer design systems being in simplified form based on the sheet metal thickness or the bending radius. However, wedge-like recesses having dimensions in the simplified form cannot generally be used for a subsequent laser welding processes or other subsequent processes that typically require comparatively tight tolerances because the wedge-like recesses having dimensions in the simplified form are not configured in a process-specific manner with regard to subsequent methods and cannot accommodate a change in the geometry factors (bending lines, overlapping, etc.).

In some embodiments, in the sheet metal blank, the intersection of the two wedge members, which are considered to be extended beyond the rounded wedge tip, is provided at a distance u from the bending line of the first bending member and at a distance x from the bending line of the second bending member. The first wedge member is defined by the intersection and another point which is provided at a distance v from the bending line of the first bending member and at a distance z from the bending line of the second bending member and terminates at the blank edge of the first bending member. The second wedge member is defined by the intersection and another point which is provided at a distance T from the bending line of the first bending member and at a distance y from the bending line of the second bending member and terminates at the blank edge of the second bending member. In the sheet metal blank, the distances T, u, v, x, y, z are defined in accordance with the inner bending radii $R_{i,1}$, $R_{i,2}$ of the sheet metal members of the sheet metal component to be bent, the sheet metal thickness S and a shortening factor VK by which the sheet metal blank is extended during bending, as:

$$T=(0.7*S+VK/2)\pm 20\%,$$

$$u=(1.0*R_{i,1})\pm 20\%,$$

$$v=(1.0*R_{i,1})\pm 20\%,$$

$$x=(1.0*R_{i,2})\pm 20\%,$$

$$y=(0.25*R_{i,2})\pm 20\%, \text{ and}$$

$$z=(VK/2-0.1)\pm 20\%.$$

The two sheet metal members are typically each bent by the same inner bending radius.

In bending, the sheet metal edge is compressed on the inside and stretched on the outside. If the outer edge of the part is measured after bending, the segment is longer than it was before. So that the bender can produce the planned dimensions of the finished bent part, the design engineer must shorten the blank by a so called shortening factor which is an empirically determined value of the blank. Reversely said, a blank of given length is extended by the shortening factor during bending.

The dependence of the construction dimensions of the wedge-like recess on the bending radii affords the advantage that the bending angle, material, and the combination of the upper tool and lower tool are also directly considered during free bending by means of bending radii, sheet metal thickness and shortening factor. Therefore, the geometry of the wedge-like recess is adapted to the respective sheet metal component. A computer-based control of the construction dimensions can further be stored in computer aided technology (CAx) systems, such as computer-aided design (CAD) and computer-aided manufacturing (CAM) systems.

A gap of the three-sided corner provided between the two bent sheet metal members typically is less than approximately 0.2 mm.

In regions having visible seams, it is advantageous for the two blank edges of the two bent sheet metal members to overlap each other. The desired overlapping of the two bent sheet metal members is typically at least approximately 70% of the sheet metal thickness of the sheet metal blank.

In some embodiments, the transition between the first wedge member and the blank edge of the first bending member in the sheet metal blank is rounded with a radius w which is also defined by the inner bending radius of the first bending member: $w=(1.5*R_{i,1})\pm 20\%$.

In the sheet metal blank, the bending line of the first bending member is typically spaced-apart in a parallel manner from the second sheet metal blank edge which is considered to be extended into the first sheet metal member by approximately (0.7±0.2) times the sheet metal thickness of the sheet metal blank and the wedge tip is rounded with a radius of a maximum of approximately 0.2 mm, (e.g., approximately 0.1 mm).

In some aspects of the invention, a sheet metal blank includes the features described herein to be bent into the above-described three-sided sheet metal component.

In some aspects of the invention, methods for producing processing programs for operating a sheet metal processing machine include control commands which produce the above-described sheet metal blank when the processing program is executed on the sheet metal processing machine.

In some aspects of the invention, computer programs include codes to carry out the steps of the methods and processing programs described herein on data processing systems.

In some aspects of the invention, methods for producing a three-sided corner of a sheet metal component bent from a sheet metal blank includes providing the above-described sheet metal blank, bending the two sheet metal members of the sheet metal blank to form the three-sided corner; and welding (e.g., laser-welding) the two sheet metal members.

In some aspects of the invention, methods include optimizing a wedge-like recess in the internal corner of a sheet metal blank which is provided for being bent to form a sheet metal component having a three-sided corner, the wedge-like recess being formed by two wedge members, a rounded wedge tip, and two sheet metal members of the sheet metal blank forming the internal corner being bent by an inner bending radius in order to form the three-sided corner.

In some embodiments, provisions for the intersection of the two wedge members which are considered to extend beyond the rounded wedge tip are provided at a distance u from the bending line of the first bending member and at a distance x from the bending line of the second bending member, for the first wedge member to be defined by the intersection and another point which is provided at a distance v from the bending line of the first bending member and at a distance z from the bending line of the second bending member and to terminate at the blank edge of the first bending member, for the second wedge member to be defined by the intersection and another point which is provided at a distance T from the bending line of the first bending member and at a distance y from the bending line of the second bending member, and to terminate at the blank edge of the second bending member. The distances T, u, v, x, y, z are selected in accordance with the inner bending radii $R_{i,1}$, $R_{i,2}$ of the sheet metal members of the sheet metal component to be bent, the sheet metal thickness S, and the shortening factor VK by which the sheet metal blank is extended during bending, as:

$$T=(0.7*S+VK/2)\pm 20\%,$$

$$u=(1.0*R_{i,1})\pm 20\%,$$

$$v=(1.0*R_{i,1})\pm 20\%,$$

$$x=(1.0*R_{i,2})\pm 20\%,$$

$$y=(0.25*R_{i,2})\pm 20\%, \text{ and}$$

$$z=(VK/2-0.1)\pm 20\%.$$

Embodiments can include one or more of the following advantages.

Optimization methods described herein for constructing sheet metal components for laser welding typically allow for more accurate calculation of the construction dimensions of a wedge-like recess for bends of the two bending members in accordance with laser welding.

In some embodiments, forming a three-sided sheet metal corner using the methods described herein allows for execution of subsequent processing steps in a reliable manner with small gap dimensions (e.g., 0.1 mm to 0 2 mm) having tight tolerances, and typically for sheet metal thicknesses of from 1 to 2 mm for the materials $S_{235}$, $X_5CrNi_{18\text{-}10}$ and $AlMg_3$.

In some embodiments, forming a three-sided sheet metal corner using the methods described herein allows for reducing the gap width provided between the two bent sheet metal members to meet requirements such as a small gap width for subsequent laser-welding of the two bent sheet metal members or a small gap width for visible edges.

Other advantages of the invention will be appreciated from the claims, description and drawings. The above-mentioned features and those set out below can also be used individually or together in any combination. The embodiments shown and described are not intended to be understood to be a conclusive listing but instead are of exemplary character for describing the invention. In the drawings:

DETAILED DESCRIPTION

Figure 1:
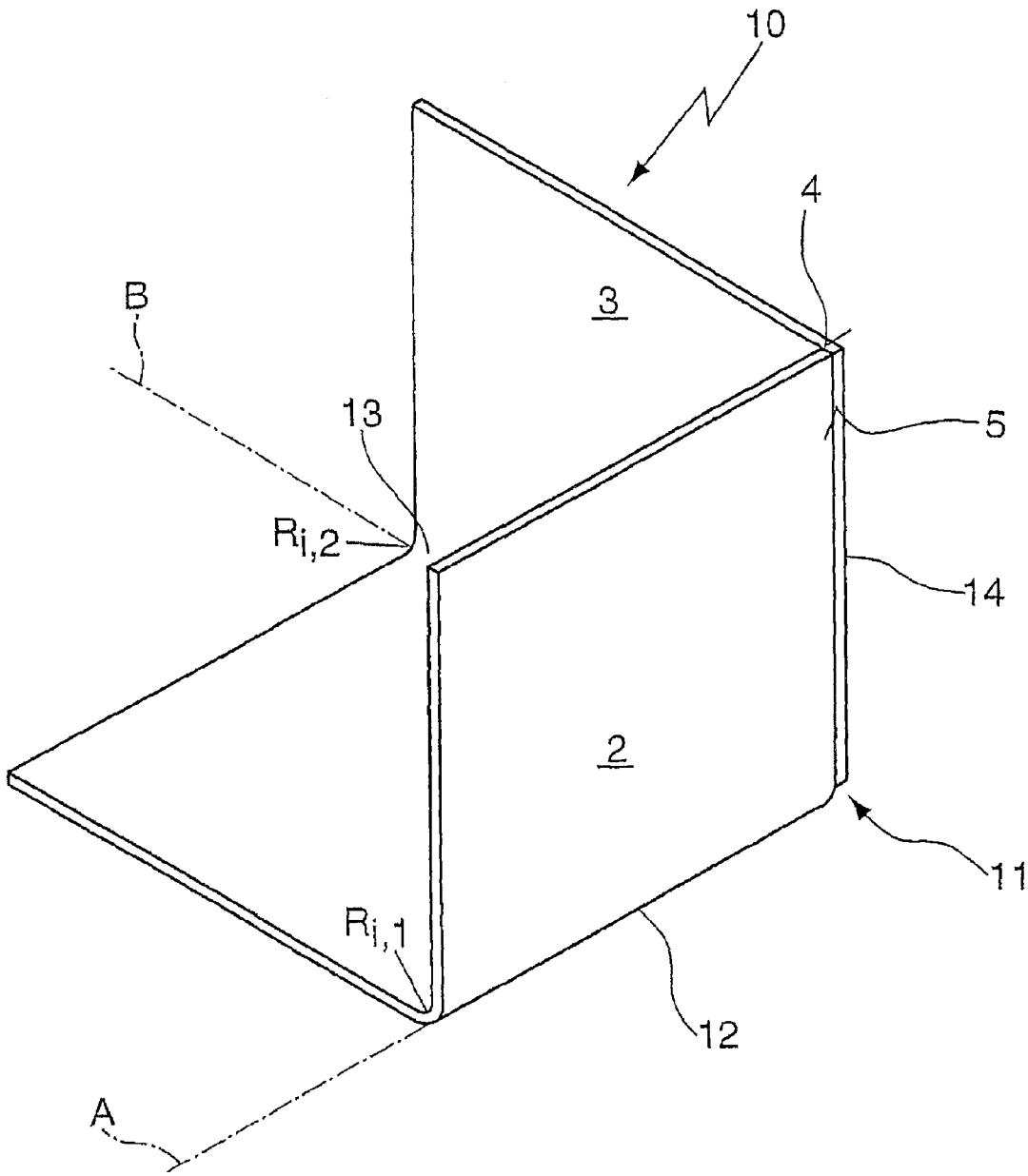
FIG. 1 is a perspective view of a sheet metal component having a three-sided corner.

FIG. 1 shows a sheet metal component 10 having a three-sided corner 11 with two edges 12, 13 that are formed by a first and a second sheet metal member 2, 3 of a sheet metal blank 1 bent by inner bending radii $R_{i,1}$, $R_{i,2}$, respectively, and a third edge 14 that is formed by the two sheet metal members 2, 3 which are bent so as to overlap each other. The third edge 14 is further foamed by laser-welding blank edges 4, 5 of the two bent sheet metal members 2, 3. In the embodiment shown, the two sheet metal members 2, 3 are bent by the same inner bending radius (i.e., $R_{i,1}=R_{i,2}$) and are bent 90° by free bending about bending lines A and B, respectively. The overlapping of the two bent sheet metal members 2, 3 is at least approximately 70% of the sheet metal thickness of the sheet metal blank 1. If present at all, a gap of the three-sided corner 11 provided between the two bent sheet metal members 2, 3 is a maximum of approximately 0.2 mm.

Figure 2:
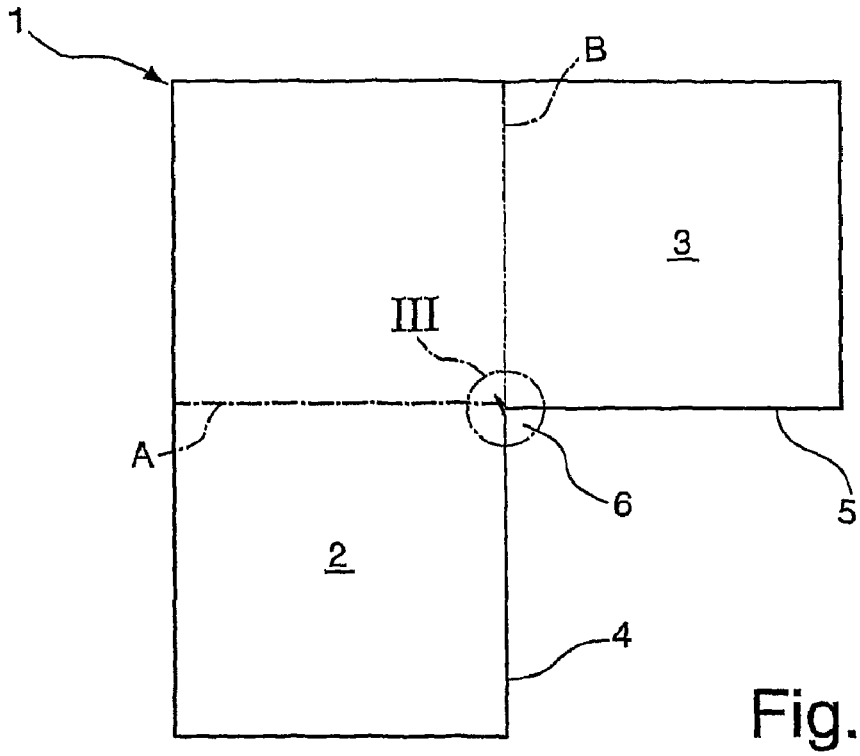
FIG. 2 is a top view of a sheet metal blank from which the sheet metal component of FIG. 1 is manufactured.
Figure 3:
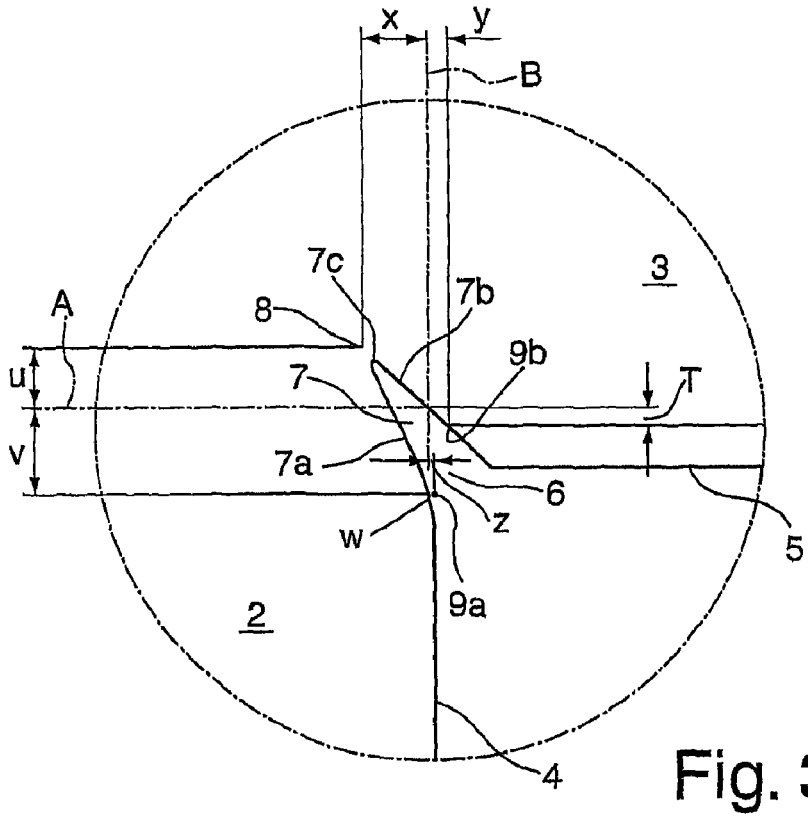
FIG. 3 is an enlarged view of area III of the sheet metal blank shown in FIG. 2.

As shown in FIGS. 2 and 3, the planar sheet metal blank 1 has an internal corner 6 which forms the two blank edges 4, 5 and a wedge-like recess 7 that opens in the internal corner 6 and is formed by two wedge members 7*a*, 7*b* and a rounded wedge tip 7*c*. The bending line A of the first bending member 2 considered to be extended into the second sheet metal member 3 extends between the second blank edge 5 and the rounded wedge tip 7*c* and has parallel spacing from the second blank edge 5 by approximately 0.7±0.2 times the sheet metal thickness S of the sheet metal blank 1. The bending line B of the second bending member 3 considered to be extended into the first sheet metal member 2 extends parallel with the first blank edge 4.

The wedge-like recess 7 is defined by three points 8, 9*a*, 9*b*. The point 8 is located in the sheet metal blank 1 at a distance u from the bending line A of the first bending member 2 and at a distance x from the bending line B of the second bending member 3. The point 9*a* is located in the sheet metal blank 1 at a distance v from the bending line A of the first bending member 2 and at a distance z from the bending line B of the second bending member 3. The point 9*b* is located in the sheet metal blank 1 at a distance T from the bending line A of the first bending member 2 and at a distance y from the bending line B of the second bending member 3. The first wedge member 7*a* is defined by the points 8, 9*a*, and the second wedge member 7*b* is defined by the points 8, 9*b*. The two wedge members 7*a*, 7*b* terminate at the blank edges 4, 5, and the wedge tip 7*c* is rounded with a maximum radius of approximately 0.2 mm (e.g., approximately 0.1 mm). The point 8 is located at the theoretical intersection of the two wedge members 7*a*, 7*b*, which is located beyond the rounded wedge tip 7*c*, i.e., outside the wedge-like recess 7. The transition between the first wedge member 7*a* and the first blank edge 4 is further rounded with a tangential radius w so that the point 9*a* is located within the wedge-like recess 7. Because the wedge members 7*a*, 7*b* are defined by the points 9*a*, 9*b*, the distance by which the bending lines A, B are spaced apart from the blank edges 4, 5 in a parallel manner is typically not critical. However, it is typically desired that the two wedge members 7*a*, 7*b* extend through the points 9*a*, 9*b* and then terminate at the blank edges 4, 5.

As shown in FIG. 3, the bending line B of the second bending member 3 also has parallel spacing from the first sheet metal blank edge 4 by the dimension z so that the point 9*a* is located along a line formed by the first blank edge 4 and is positioned within the wedge-like recess 7 near a rounded transition between the first edge member 7*a* and the first blank edge 4.

So that either no gap at all is provided between the two bent sheet metal members 2, 3, or alternatively, a maximum gap width of 0.1 to 0.2 mm is not exceeded, the distances u, v, x, y and the radius w are selected as follows based on the inner bending radii $R_{i,1}$, $R_{i,2}$ of the sheet metal members 2, 3 of the sheet metal component 10 to be bent. The distances T, z are determined as follows based on the sheet metal thickness S and the shortening factor VK by which the sheet metal blank 1 extends during bending (e.g., during the 90° free bending):

$$T=(0.7*S+VK/2)\pm 20\%,$$

$$u=(1.0*R_{i,1})\pm 20\%,$$

$$v=(1.0*R_{i,1})\pm 20\%,$$

$$x=(1.0*R_{i,2})\pm 20\%,$$

$$y=(0.25*R_{i,2})\pm 20\%,$$

$$w=(1.5*R_{i,1})\pm 20\%, \text{ and}$$

$$z=(VK/2-0.1)\pm 20\%.$$

The distances T, u, v, x, y, z and the radius w calculated in this manner may have specific tolerances of a maximum of ±20% (e.g., a maximum of ±10%).

Figure 4:
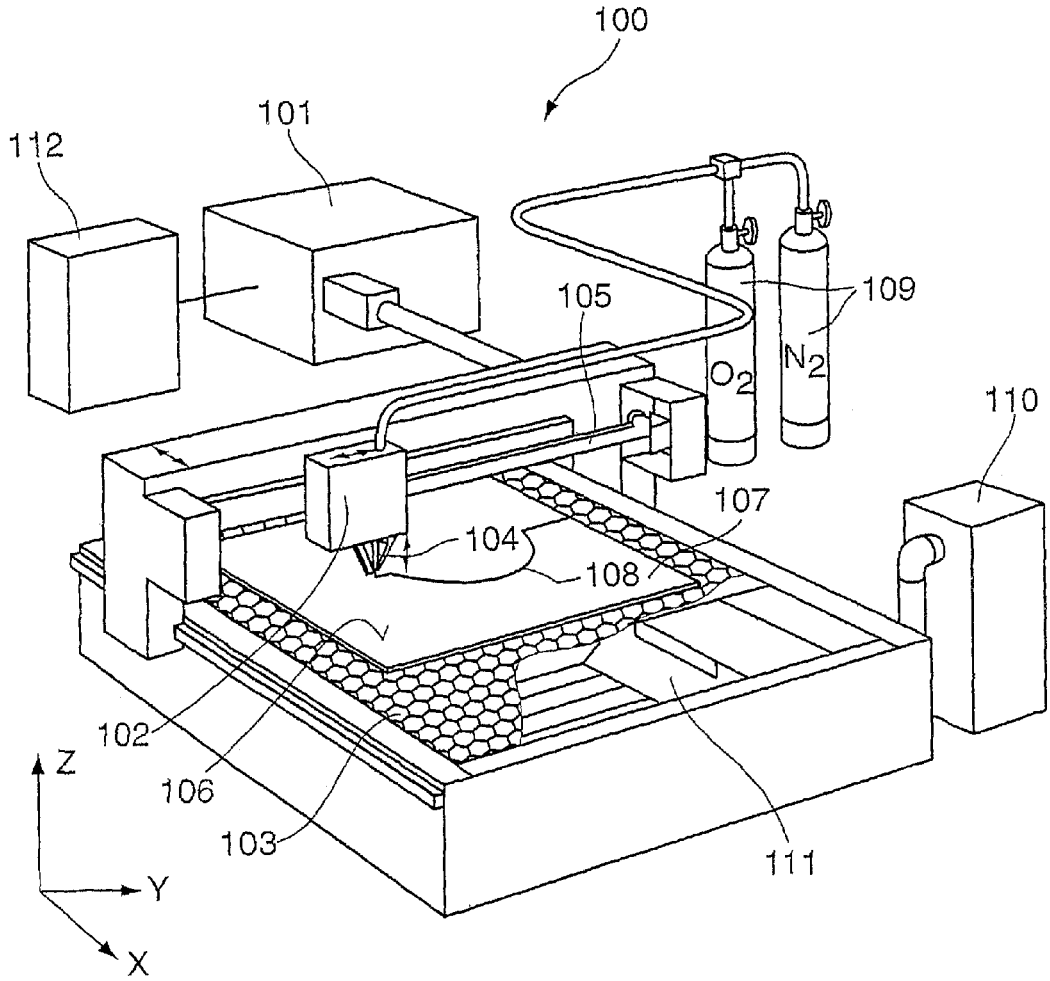
FIG. 4 is a perspective view of a laser processing machine for producing a sheet metal blank.

FIG. 4 shows a sheet metal processing machine (e.g., a $CO_2$ laser cutting machine) 100 for laser-cutting metal sheets. The laser cutting machine 100 is suitable for producing the sheet metal blank 1 (shown in FIG. 2). The laser cutting machine 100 has a $CO_2$ laser resonator 101, a laser processing head 102 and a workpiece support 103. A laser beam 104 produced by the laser resonator 101 is directed to the laser processing head 102 by a beam guide 105 of redirecting mirrors and focused therein, and orientated perpendicularly to the surface 106 of a sheet metal workpiece 107 by using mirrors (i.e., the beam axis (optical axis) of the laser beam 104 extends perpendicularly to the workpiece 107). In order to laser-cut the workpiece 107, piercing is first carried out with the laser beam 104 (i.e., the workpiece 107 is melted or oxidized in a point-like manner at a location and the molten mass which results in this instance is discharged). The laser beam 104 is subsequently moved over the workpiece 107 so that the laser beam 104 separates the workpiece 107 along a continuous gap 108.

Both the piercing and the laser-cutting can be supported by addition of a cutting gas. Oxygen, nitrogen, compressed air and/or other application-specific gases can be used as cutting gases 109. The cutting gas which is ultimately used depends on which materials are being cut and the quality requirements which are placed on the workpiece. Resultant particles and gases can be discharged from a discharge chamber 111 by means of a discharge device 110. A control device 112 is included for controlling the laser cutting machine 1 and for controlling the movement of the laser processing head 102.

A number of embodiments of the invention have been described. Nevertheless, it will be understood that various modifications may be made without departing from the spirit and scope of the invention. Accordingly, other embodiments are within the scope of the following claims.

What is claimed is:

1. A method comprising:

forming a sheet metal blank comprising:

a first bending member that forms a first blank edge;

a second bending member that forms a second blank edge; and a wedge-shaped recess that is formed by a first straight segment of the blank, a second segment of the blank, and a rounded segment of the blank that interconnects the first and second straight segments, in the sheet metal blank, a first point is located at an intersection of lines along which the first and second straight segments extend, the first point being positioned at a distance u from a first bending line of the first bending member and at a distance x from a second bending line of the second bending member, the first straight segment extending along a line that passes through the first point and a second point, the second point being positioned at a distance v from the first bending line of the first bending member and at a distance z from the second bending line of the second bending member, the first straight segment terminating at the first blank edge of the first bending member, the second straight segment extending along a line that passes through the first point and a third point, the third point being positioned at a distance T from the first bending line of the first bending member and at a distance y from the second bending line of the second bending member, the second straight segment terminating at the second blank edge of the second bending member, in the sheet metal blank, the distances T, u, v, x, y, z are selected in accordance with the first inner bending radius $R_{i,1}$, the second inner bending radius $R_{i,2}$, the thickness S of sheet metal blank, and a shortening factor VK by which the sheet metal blank is extended during bending, as:

$$T=(0.7*S+VK/2)\pm 20\%,$$

$$u=(1.0*R_{i,1})\pm 20\%,$$

$$v=(1.0*R_{i,1})\pm 20\%,$$

$$x=(1.0*R_{i,2})\pm 20\%,$$

$$y=(0.25*R_{i,2})\pm 20\%, \text{ and}$$

$$z=(VK/2-0.1)\pm 20\%; \text{ and}$$

forming said sheet metal blank into a shape by bending said first and second bending member.

2. The method according to claim 1, wherein a transition between the first straight segment and the first blank edge is rounded having a radius w which is selected in accordance with the first inner bending radius $R_{i,1}$ of the first bending member as: $w=(1.5*R_{i,1})\pm 20\%$.

3. The method according to claim 1, wherein the first bending line of the first bending member is spaced-apart in a parallel manner from the second blank edge by approximately 0.5 to 0.9 times the sheet metal thickness of the sheet metal blank.

4. The method according claim 1, wherein the rounded segment is rounded with a radius less than 0.2 mm.

5. The method according claim 4, wherein the rounded segment is rounded with a radius less than 0.1 mm.

6. The method according to claim 1, further comprising forming the sheet metal blank into a sheet metal component having a three-sided corner, wherein forming the sheet metal blank into a sheet metal component having a three-sided corner comprises:

bending the first bending member about the first bending line to form a first edge of the three-sided corner, the inner bending radius formed along the first bending line being the first inner bending radius $R_{i,1}$; and bending the second bending member about the second bending line to form a second edge of the three-sided corner, the inner bending radius formed along the second bending line being the second inner bending radius $R_{i,2}$, wherein a third edge of the three-sided corner is formed by the first blank edge and the second blank edge.

7. The method according to claim 6, further comprising welding the first and second bending members to each other.

8. The method according to claim 7, wherein the first and second bending members are laser-welded to each other.

9. A sheet metal component formed by a process comprising:

forming a sheet metal blank comprising:

a first bending member that forms a first blank edge;

a second bending member that forms a second blank edge; and a wedge-shaped recess that is formed by a first straight segment of the blank, a second segment of the blank, and a rounded segment of the blank that interconnects the first and second straight segments, in the sheet metal blank, a first point is located at an intersection of lines along which the first and second straight segments extend, the first point being positioned at a distance u from a first bending line of the first bending member and at a distance x from a second bending line of the second bending member, the first straight segment extending along a line that passes through the first point and a second point, the second point being positioned at a distance v from the first bending line of the first bending member and at a distance z from the second bending line of the second bending member, the first straight segment terminating at the first blank edge of the first bending member, the second straight segment extending along a line that passes through the first point and a third point, the third point being positioned at a distance T from the first bending line of the first bending member and at a distance y from the second bending line of the second bending member, the second straight segment terminating at the second blank edge of the second bending member, in the sheet metal blank, the distances T, u, v, x, y, z are selected in accordance with the first inner bending radius $R_{i,1}$, the second inner bending radius $R_{i,2}$, the thickness S of sheet metal blank, and a shortening factor VK by which the sheet metal blank is extended during bending, as:

$$T=(0.7*S+VK/2)\pm 20\%,$$

$$u=(1.0*R_{i,1})\pm 20\%,$$

$$v=(1.0*R_{i,1})\pm 20\%,$$

$$x=(1.0*R_{i,2})\pm 20\%,$$

$$y=(0.25*R_{i,2})\pm 20\%, \text{ and}$$

$$z=(VK/2-0.1)\pm 20\%.$$

* * * * *